US008519269B2

(12) United States Patent
Tsukamoto et al.

(10) Patent No.: US 8,519,269 B2
(45) Date of Patent: Aug. 27, 2013

(54) CONDUCTOR OF AN ELECTRIC WIRE, AND AN INSULATED WIRE

(75) Inventors: Soichirou Tsukamoto, Yokkaichi (JP); Jun Yoshimoto, Yokkaichi (JP); Yasuyuki Otsuka, Yokkaichi (JP); Akihiko Tanaka, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 77 days.

(21) Appl. No.: 13/067,699

(22) Filed: Jun. 21, 2011

(65) Prior Publication Data

US 2011/0247857 A1 Oct. 13, 2011

Related U.S. Application Data

(62) Division of application No. 12/448,168, filed as application No. PCT/JP2007/075059 on Dec. 27, 2007, now Pat. No. 8,017,869.

(30) Foreign Application Priority Data

Dec. 28, 2006 (JP) ..... 2006-354976

(51) Int. Cl.
*H01B 5/08* (2006.01)

(52) U.S. Cl.
USPC ..... 174/128.1

(58) Field of Classification Search
USPC ..... 174/128.1, 128.2
See application file for complete search history.

(56) References Cited

U.S. PATENT DOCUMENTS

| | | | | |
|---|---|---|---|---|
| 6,303,868 | B1 | 10/2001 | Kawai | |
| 6,627,009 | B1 | 9/2003 | Matsui et al. | |
| 6,751,855 | B2 * | 6/2004 | Matsui et al. | 29/825 |
| 6,900,391 | B1 | 5/2005 | Maeda | |
| 2001/0051105 | A1 * | 12/2001 | Miyoshi et al. | 420/477 |
| 2004/0231883 | A1 | 11/2004 | Kondo et al. | |
| 2005/0028907 | A1 | 2/2005 | Hasegawa et al. | |
| 2006/0196586 | A1 | 9/2006 | Hasegawa et al. | |

FOREIGN PATENT DOCUMENTS

| | | | |
|---|---|---|---|
| CN | 1310454 | A | 8/2001 |
| EP | 281038 | * | 9/1988 |
| EP | 1 793 390 | A1 | 6/2007 |
| JP | 57105694 | * | 7/1982 |

(Continued)

OTHER PUBLICATIONS

May 10, 2012 Office Action issued in Chinese Patent Application No. 200780048599.4; with English-language translation.

*Primary Examiner* — Chau Nguyen
(74) *Attorney, Agent, or Firm* — Oliff & Berridge, PLC

(57) ABSTRACT

A conductor of an electric wire, and an insulated wire which are excellent in corrosion resistance and recyclability, of which the strength which is decreased by weight reduction and diameter reduction is improved. The conductor includes a strand which includes a first elemental wire made from pure copper and a second elemental wire made from a copper alloy. In the conductor, a cross-sectional area of the first elemental wire as a percentage of a cross-sectional area of the conductor is preferably within a range of 10 to 90%. Examples of the copper alloy include a Cu—Ni—Si alloy, and a copper alloy containing Sn, Ag, Mg, or Zn. The conductor may be compressed concentrically. The insulated wire is prepared by covering the conductor with an insulator.

12 Claims, 4 Drawing Sheets

(56) References Cited

FOREIGN PATENT DOCUMENTS

| | | | |
|---|---|---|---|
| JP | A-02-142016 | | 5/1990 |
| JP | U-6-13014 | | 2/1994 |
| JP | A-6-96618 | | 4/1994 |
| JP | A-7-249315 | | 9/1995 |
| JP | A-11-224538 | | 8/1999 |
| JP | A-2000-228116 | | 8/2000 |
| JP | A-2001-148206 | | 5/2001 |
| JP | 2002-129262 | * | 5/2002 |
| JP | A-2004-207079 | | 7/2004 |
| JP | A-2006-32084 | | 2/2006 |
| WO | WO 03/076672 A1 | | 9/2003 |

* cited by examiner

20a

20b

20c

20d

30a

30b

30c

30d

40a

40b

40c

CONDUCTOR OF AN ELECTRIC WIRE, AND AN INSULATED WIRE

This application is a Divisional of application Ser. No. 12/448,168 filed Jun. 11, 2009, which is a National Phase of PCT/JP2007/075059 filed on Dec. 27, 2007, based on Japanese Application Numbers 2006-354976 filed on Dec. 28, 2006, the entire contents of which are incorporated herein by reference.

TECHNICAL FIELD

The present invention relates to a conductor of an electric wire, and an insulated wire, and more specifically relates to a conductor of an electric wire, and an insulated wire which are suitably used for an automotive electric wire.

BACKGROUND ART

Conventionally, for an insulated wire used in a vehicle such as an automobile, and electric/electronic equipment, there is widespread use of an insulated wire which includes a conductor prepared by stranding a plurality of elemental wires made from pure copper such as tough pitch copper.

Recently, the performance of a vehicle such as an automobile, and an electric/electronic equipment has been rapidly improved, increasing the number of various control circuits and other components used therein, and accompanied with this increase, the number of insulated wires used therein is also increasing.

In the field of automobiles, weight reduction of a vehicle is desired from the viewpoint of energy saving. Hence, as part of the weight reduction of a vehicle, attempts to achieve weight reduction of an insulated wire have been made. For example, weight reduction of a conventional insulated wire has been achieved by reducing the diameter of a conductor included therein because the conventional insulated wire has sufficient current-carrying capacity.

However, there is a problem that the insulated wire decreases in strength when the diameter of the conductor is reduced. Hence, attempts have been made to improve the strength of the insulated wire including the conductor having the reduced diameter.

For example, a conductor of an automotive electric wire which is prepared by stranding a plurality of elemental wires made from stainless steel and an elemental wire made from copper in combination is disclosed in Japanese Patent Application Unexamined Publication No. 2004-207079.

DISCLOSURE OF THE INVENTION

Problem to be Solved by the Invention

However, if the conductor prepared by stranding the elemental wires of stainless steel and the elemental wire of copper in combination is left wet for a long period of time, bimetallic corrosion could build up in the conductor. In addition, the stainless steel and the copper in the conductor are difficult to separate in a recycling process of the insulated wire because the stainless steel and the copper in the conductor are a ferrous material and a non-ferrous metal material, respectively, and therefore, there arises a problem that the insulated wire is difficult to recycle as a ferrous material. There also arises a problem that the insulated wire is difficult to recycle as a non-ferrous metal because the degree of purity of the non-ferrous metal is low.

An object of the present invention is to provide a conductor of an electric wire, and an insulated wire, which are excellent in corrosion resistance and recyclability, improving the strength of the conductor and the insulated wire which is decreased by weight reduction and diameter reduction.

Means for Solving Problem

To achieve the objects and in accordance with the purpose of the present invention, a conductor according to a preferred embodiment of the present invention includes a strand which includes a first elemental wire made from pure copper and a second elemental wire made from a copper alloy.

In this case, it is desired that a cross-sectional area of the first elemental wire as a percentage of a cross-sectional area of the conductor is within a range of 10 to 90%.

The copper alloy preferably contains Ni whose content is 1.5 to 4.0 mass %, Si whose content is 0.4 to 0.6 mass %, and a remainder essentially including Cu and an unavoidable impurity.

Alternatively, the copper alloy preferably contains one or more elements selected from the group consisting of Sn, Ag, Mg, and Zn, where a total content of the one or more elements is 0.15 to 1.0 mass %, and a remainder essentially includes Cu and an unavoidable impurity.

The conductor is preferably used especially in a thin wire whose conductor has a cross-sectional area of 0.5 $mm^2$ or less.

Further, the conductor may be compressed concentrically.

Meanwhile, an insulated wire according to a preferred embodiment of the present invention includes the above-described conductor.

Effects of the Invention

Including the strand of the first elemental wire made from the pure copper and second elemental wire made from the copper alloy, the conductor according to the preferred embodiment of the present invention is improved in strength compared with a conventional conductor including a strand only of elemental wires made from pure copper. Hence, the strength of the conductor according to the preferred embodiment of the present invention which is decreased by weight reduction and diameter reduction can be improved. In addition, owing to the property of pure copper to be more excellent in electrical conductivity than a copper alloy, allowable current of the conductor according to the preferred embodiment of the present invention can be increased because the conductor has lower conductor resistance than a conductor including a strand only of elemental wires made from a copper alloy.

A standard electrode potential difference is small between the pure copper from which the first elemental wire is made and the copper alloy from which the second elemental wire is made, so that even if the conductor is left wet for a long period of time, bimetallic corrosion does not easily build up, and the conductor is accordingly excellent in corrosion resistance. Further, since the first elemental wire and second elemental wire are each made from a copper-based material, the conductor can be recycled as a copper-based material without separation, and the conductor is accordingly excellent in recyclability.

In this case, if the cross-sectional area of the first elemental wire as a percentage of the cross-sectional area of the conductor is within the range of 10 to 90%, the conductor obtains an advantage of improved strength, and is excellent in electrical conductivity.

If the copper alloy contains Ni whose content is 1.5 to 4.0 mass %, Si whose content is 0.4 to 0.6 mass %, and the remainder essentially including Cu and the unavoidable impurity, the conductor obtains an advantage of improved strength, and is excellent in electrical conductivity.

Alternatively, if the copper alloy contains one or more elements selected from the group consisting of Sn, Ag, Mg, and Zn, where the total content of the one or more elements is 0.15 to 1.0 mass %, and the remainder essentially includes Cu and the unavoidable impurity, the conductor obtains an advantage of improved strength, and is excellent in electrical conductivity.

Since the conductor can be used in a thin wire whose conductor has a cross-sectional area of 0.5 $mm^2$ or less, weight reduction of an insulated wire in the field of automobiles, for example, can be achieved.

Further, if the conductor is compressed concentrically, clearance between the elemental wires is decreased. Thus, when seen from the same cross section, the diameter of the compressed conductor can be reduced.

Meanwhile, since the insulated wire according to the preferred embodiment of the present invention includes the above-described conductor, the insulated wire is high in strength, and is resistant to corrosion deterioration. Hence, the insulated wire is suitably used as a thin wire whose conductor has a cross-sectional area of 0.5 $mm^2$ or less, for example. Therefore, using the insulated wire in the field of automobiles, for example, can contribute to weight reduction of a vehicle.

BEST MODE FOR CARRYING OUT THE INVENTION

Figure 1A:
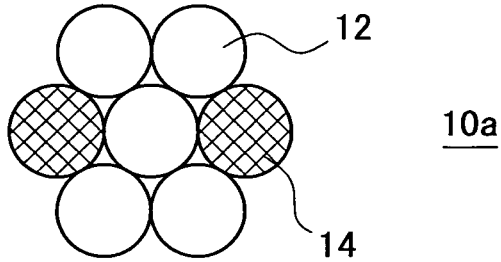
FIGS. 1A to 1D are sectional views of conductors according to a preferred embodiment of the present invention, where the conductors are each made up of seven elemental wires.

A detailed description of preferred embodiments of the present invention will now be provided. In the following description, the percentage of content of each constituent element refers to mass %.

A conductor according to the preferred embodiment of the present invention is prepared by stranding a first elemental wire made from pure copper and a second elemental wire made from a copper alloy. The conductor is made up of one or more of the first elemental wires, and one or more of the second elemental wires.

The pure copper from which the first elemental wire is made has a purity of 99.9% or more, and examples of which include tough pitch copper, oxygen free copper, and phosphorous-deoxidized copper. Among them, the tough pitch copper is preferable in terms of low price, and the oxygen free copper is preferable in terms of not easily producing hydrogen embrittlement because it contains only a tiny amount of oxygen in its copper.

For the first elemental wire made from the pure copper, a copper wire for electric purpose in accordance with JIS C3102 is preferably used.

The copper alloy from which the second elemental wire is made is not limited specifically, and examples of which include a Cu—Ni—Si alloy, and a copper alloy containing Sn, Ag, Mg, or Zn.

The Cu—Ni—Si alloy preferably contains Ni whose content is 1.5 to 4.0%, Si whose content is 0.4 to 0.6%, and a remainder essentially including Cu and an unavoidable impurity. The Cu—Ni—Si alloy more preferably contains Ni whose content is 2.0 to 3.0%, and Si whose content is 0.4 to 0.6%.

This is because if Ni is less than 1.5% or Si is less than 0.4%, an advantage of improved strength of the conductor is apt to be reduced. On the other hand, if Ni is more than 4.0% or Si is more than 0.6%, conductor resistance of the conductor is apt to increase, so that allowable current of a wire including the conductor is apt to decrease, and accordingly the wire is not easily used as a power wire.

The copper alloy containing Sn, Ag, Mg, or Zn may contain only one of these metallic elements, and a remainder essentially including Cu and an unavoidable impurity. Alternatively, the copper alloy may contain more than one of these metallic elements, and a remainder essentially including Cu and an unavoidable impurity. A total content of the one or the more than one of the metallic elements added to the copper alloy is preferably within a range of 0.15 to 1.0 mass %.

This is because if the total content is less than 0.15 mass %, the advantage of improved strength of the conductor is apt to be reduced. On the other hand, if the total content is more than 1.0 mass %, conductor resistance of the conductor is apt to increase, so that allowable current of a wire including the conductor is apt to decrease, and accordingly the wire is not easily used as a power wire.

The conductor is a combination of the first elemental wire and the second elemental wire. If the proportion of the first elemental wire made from the pure copper is larger in the combination, electrical conductivity of the conductor is easily improved while the conductor is apt to decrease in strength. On the other hand, if the proportion of the second elemental wire made from the copper alloy is larger in the combination, the conductor easily increases in strength while its electrical conductivity is apt to be reduced. Hence, it is preferable to combine the first and second elemental wires in consideration of electrical conductivity and an advantage of improved strength.

The proportion of the first elemental wire is expressed by a cross-sectional area of the first elemental wire as a percentage of a cross-sectional area of the conductor. The cross-sectional area of the first elemental wire refers to a cross-sectional area of the whole of the one or more first elemental wires.

The cross-sectional area of the first elemental wire as a percentage of the cross-sectional area of the conductor is preferably within a range of 10 to 90%, and more preferably within a range of 40 to 70%. This is because if the cross-sectional area of the first elemental wire as a percentage of the cross-sectional area of the conductor is less than 10%, conductor resistance of the conductor is apt to increase, so that allowable current of a wire including the conductor is apt to decrease, and accordingly the wire is not easily used as a power wire. On the other hand, if it is more than 90%, the advantage of improved strength of the conductor is apt to be reduced.

The conductor preferably has electrical conductivity of 45% IACS or more in consideration of an amount of the allowable current of the wire in the case of being used as a power wire, for example. In addition, the conductor preferably has tensile strength of 300 MPa or more, and breaking elongation of 5% or more in consideration of the strength of the conductor.

The cross-sectional area of the whole conductor is not limited specifically, and is preferably 0.5 $mm^2$ or less. This is because by reducing the diameter of the conductor, weight reduction of the wire can be achieved. In addition, even with the reduced diameter, the strength of the conductor can be maintained owing to the advantage of improved strength. It is to be noted that 0.5 $mm^2$ is a nominal cross-sectional area.

The number of elemental wires, and the cross-sectional area of each elemental wire are not limited specifically. It is essential only that the number and the cross-sectional area should be selected considering the proportion of the first elemental wire as described above, and then the first and second elemental wires should be combined.

If two or more second elemental wires are included in the conductor, they may be second elemental wires of the same kind which are made from copper alloys of the same composition, or the second elemental wires may be elemental wires of different kinds which are made from copper alloys of different composition.

Next, descriptions of more specific configurations of the conductor will be provided referring to FIGS. 1A to 4C. Besides, in FIGS. 1A to 4C, assume that the cross-sectional areas of the first elemental wires and the second elemental wires are all of the same size.

In FIGS. 1A to 1D, conductors each made up of seven elemental wires are shown. In this case, it is essential only that each conductor should include at least one first elemental wire and at least one second elemental wire. It is preferable that each conductor includes two to five first elemental wires.

Figure 1B:
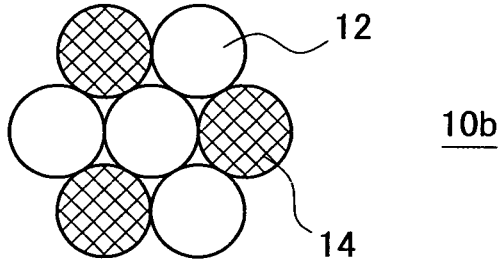

A conductor 10*a* shown in FIG. 1A is a combination of five first elemental wires 12 and two second elemental wires 14. The first elemental wires 12 are placed in the center, and the second elemental wires 14 are placed at symmetrical positions with respect to the first elemental wires 12. A conductor 10*b* shown in FIG. 1B is a combination of four first elemental wires 12 and three second elemental wires 14. One of the first elemental wires 12 is placed in the center, and the other three first elemental wires 12 and the three second elemental wires 14 are placed alternately so as to surround the first elemental wire 12 in the center.

Figure 1C:
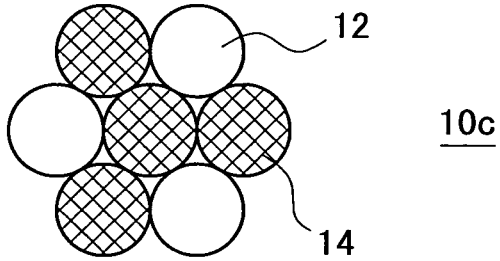
Figure 1D:
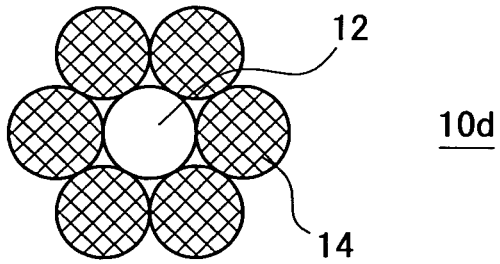

A conductor 10*c* shown in FIG. 1C is a combination of three first elemental wires 12 and four second elemental wires 14. One of the second elemental wires 14 is placed in the center, and the three first elemental wires 12 and the other three second elemental wires 14 are placed alternately so as to surround the second elemental wire 14 in the center. A conductor 10*d* shown in FIG. 1D is a combination of one first elemental wire 12 and six second elemental wires 14. The first elemental wire 12 is placed in the center, and the six second elemental wires 14 are placed so as to surround the first elemental wire 12 in the center.

In FIGS. 2A to 2D, conductors each made up of nineteen elemental wires are shown. It is essential only that each conductor should include at least two first elemental wires 12 and at least two second elemental wires 14. It is preferable that each conductor includes six to fifteen first elemental wires.

Figure 2A:
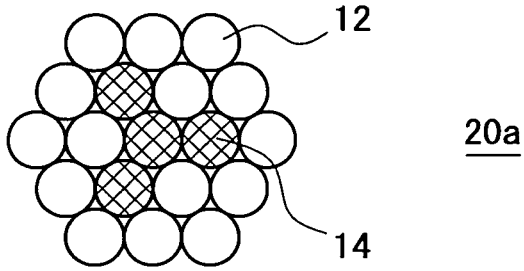
FIGS. 2A to 2D are sectional views of conductors according to the preferred embodiment of the present invention, where the conductors are each made up of nineteen elemental wires.
Figure 2B:
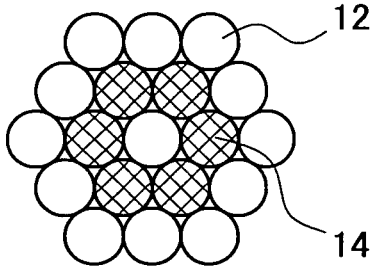

A conductor 20*a* shown in FIG. 2A is a combination of fifteen first elemental wires 12 and four second elemental wires 14. One of the second elemental wires 14 is placed in the center, three of the first elemental wires 12 and the other three second elemental wires 14 are placed alternately so as to surround the second elemental wire 14 in the center, and the other twelve first elemental wires 12 are placed so as to further surround these first and second elemental wires 12 and 14. A conductor 20*b* shown in FIG. 2B is a combination of thirteen first elemental wires 12 and six second elemental wires 14. One of the first elemental wires 12 is placed in the center, the six second elemental wires 14 are placed so as to surround the first elemental wire 12 in the center, and the other twelve first elemental wires 12 are placed so as to further surround these second elemental wires 14.

Figure 2C:
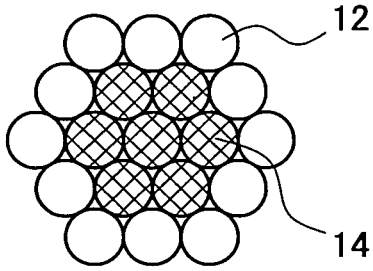
Figure 2D:
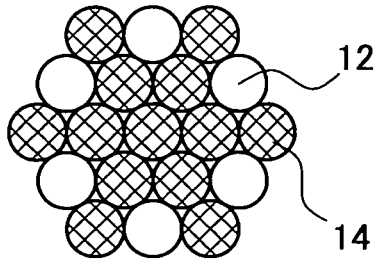
Figure 3A:
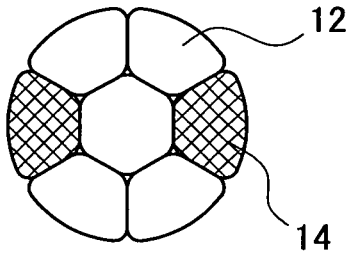
FIGS. 3A to 3D are sectional views of the conductors shown in FIGS. 1A to 1D, where the conductors are compressed concentrically.
Figure 3B:
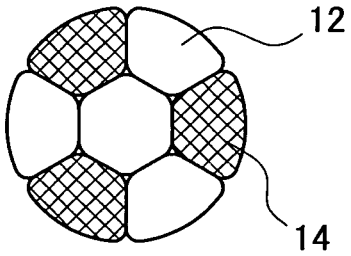
Figure 3C:
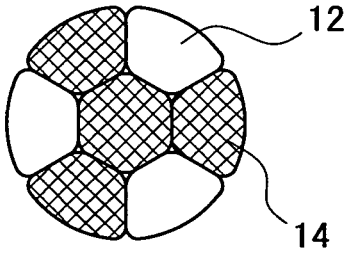
Figure 3D:
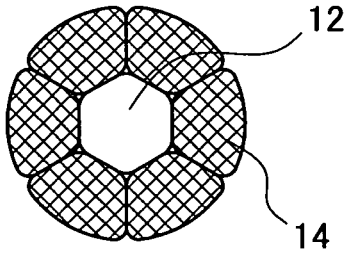

A conductor 20*c* shown in FIG. 2C is a combination of twelve first elemental wires 12 and seven second elemental wires 14. One of the second elemental wires 14 is placed in the center, the other six second elemental wires 14 are placed so as to surround the second elemental wire 14 in the center, and the twelve first elemental wires 12 are placed so as to further surround these second elemental wires 14. A conductor 20*d* shown in FIG. 2D is a combination of six first elemental wires 12 and thirteen second elemental wires 14. One of the second elemental wires 14 is placed in the center, six of the second elemental wires 14 are placed so as to surround the second elemental wire 14 in the center, and the six first elemental wires 12 and the other six second elemental wires 14 are placed alternately so as to further surround these second elemental wires 14.

In addition, the conductor may be compressed concentrically. The concentric compression can be performed preferably by making the conductor in a stranded state pass through a compression die.

In FIGS. 3A to 3D, conductors each made up of seven elemental wires and compressed concentrically are shown. The combination numbers and the placement of the first elemental wires 12 and the second elemental wires 14 of the conductors shown in FIGS. 3A to 3D are the same as those of the conductors shown in FIGS. 1A to 1D, respectively. In addition, the cross-sectional areas of the elemental wires of the conductors shown in FIGS. 3A to 3D are of the same size as those of the conductors shown in FIGS. 1A to 1D.

Compared with the conductors 10*a* to 10*d* shown in FIGS. 1A to 1D, clearance between the elemental wires is decreased by the concentric compression in each of conductors 30*a* to 30*d* shown in FIGS. 3A to 3D. Hence, the concentrically compressed conductors 30*a* to 30*d* are each reduced as a whole in diameter.

Figure 4A:
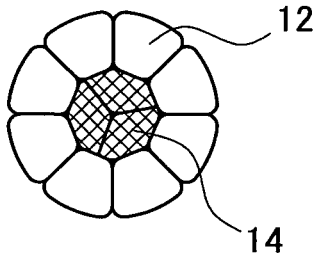
FIGS. 4A to 4C are sectional views of conductors according to another embodiment of the present invention, where the conductors are compressed concentrically.
Figure 4B:
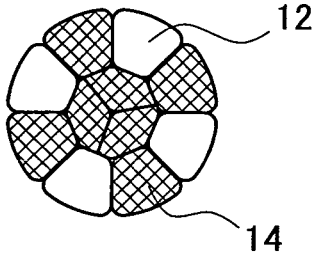
Figure 4C:
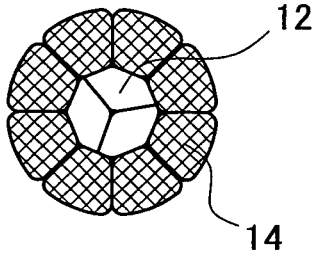

In FIGS. 4A to 4C, conductors each made up of eleven elemental wires and compressed concentrically are shown. A conductor 40*a* shown in FIG. 4A is a combination of eight first elemental wires 12 and three second elemental wires 14. The three second elemental wires 14 are placed in the center, and the eight first elemental wires 12 are placed so as to surround the second elemental wires 14 in the center. A conductor 40*b* shown in FIG. 4B is a combination of four first elemental wires 12 and seven second elemental wires 14. Three of the second elemental wires 14 are placed in the center, and the four first elemental wires 12 and the other four second elemental wires 14 are placed alternately so as to surround the second elemental wires 14 in the center.

A conductor 40*c* shown in FIG. 4C is a combination of three first elemental wires 12 and eight second elemental wires 14. The three first elemental wires 12 are placed in the center, and the eight second elemental wires 14 are placed so as to surround the first elemental wires 12 in the center. In the conductors shown in FIGS. 4A to 4C, clearance between the elemental wires is decreased by the concentric compression, similarly to the conductors shown in FIGS. 3A to 3D.

The placement of the first elemental wires 12 and the second elemental wires 14 is not limited to the placement shown in FIGS. 1A to 4C, but it is preferable that the first elemental wires 12 and the second elemental wires 14 are placed at symmetrical positions in the respective conductors as shown in FIGS. 1A to 4C. This is because the advantage of improved strength owing to the second elemental wires 14 is brought about to the whole conductor in a balanced manner. In addition, the number of elemental wires of the conductor, and the combination number of the first elemental wires 12 and the second elemental wires 14 are not limited to those of the conductors shown in FIGS. 1A to 4C.

Although, in FIGS. 1A to 4C, it is assumed that the cross-sectional areas of the first elemental wires 12 and the second elemental wires 14 are all of the same size, the present invention is not limited thereto. It is also preferable that the cross-sectional areas of the first elemental wires 12 are different from each other, and the cross-sectional areas of the second elemental wires 14 are different from each other. Yet, it is also preferable that the first elemental wires 12 have cross-sectional areas of the same size, the second elemental wires 14 have cross-sectional areas of the same size, and the cross-sectional areas of the first elemental wires 12 are different from those of the second elemental wires 14.

Next, a description of one example of a manner of producing the above-described conductor will be provided.

The first elemental wire which makes up the conductor is prepared preferably by melting electrolytic copper and subjecting it to casting and rolling to produce a wire rod, and then subjecting the wire rod to cold processing so as to have a desired diameter. The casting and rolling can be continuously performed preferably with the use of a continuous casting and rolling machine.

The second elemental wire is, if it is made from a Cu—Ni—Si alloy, prepared preferably by rapidly solidifying a molten metal of a copper alloy which is produced such that each ingredient has a desired percentage, subjecting the molten metal to cold rolling to produce a wire rod, and then subjecting the wire rod to cold processing so as to have a desired diameter. The rapid solidification of the molten metal of the copper alloy can be performed preferably with the use of an intermittent continuous-casting machine in which a water-cooled die is used.

Alternatively, if the second elemental wire is made from a copper alloy containing Sn, Ag, Mg, or Zn, it is prepared preferably by melting electrolytic copper, adding a metal such as Sn to the molten electrolytic copper such that the metal has a desired percentage, subjecting the electrolytic copper to casting and rolling to produce a wire rod, and then subjecting the wire rod to cold processing so as to have a desired diameter. Similarly to the first elemental wire, the casting and rolling can be continuously performed preferably with the use of a continuous casting and rolling machine. At this time, the metal to be added can be continuously added to the electrolytic copper such that the metal has the desired percentage during the continuous casting.

By stranding thus-prepared first elemental wire and second elemental wire of which the combination number is selected such that the first and second elemental wires have a desired proportion, the conductor is produced. Besides, thus-produced conductor may be subjected to heat treatment for the purpose of final thermal refining, as necessary.

The heat treatment for the purpose of final thermal refining can be performed with the use of various types of softening furnaces. The type of the softening furnace is not limited specifically as long as the conductor obtains a desired property. The softening furnace may be a batch-type softening furnace, or may be a continuous softening furnace. Examples of the batch-type softening furnace include a bell softening furnace. Examples of the continuous softening furnace include a conducting continuous softening furnace, a pipe continuous softening furnace, and a high-frequency continuous softening furnace.

Next, a description of an insulated wire according to a preferred embodiment of the present invention will be provided.

The insulated wire according to the preferred embodiment of the present invention is prepared by covering the above-described conductor with an insulator. The insulator may be formed of one layer, or two or more layers. When the insulator layer is formed of two or more layers, the layers may be of the same kind, or may be of different kinds.

Examples of the insulator include polyvinyl chloride, polyethylene, polypropylene, and a fluorine resin such as a PFA resin, an ETFE (ethylene tetrafluoroethylene copolymer) resin and an FEP (fluorinated ethylene propylene) resin. The thickness of the covering insulator is not limited specifically.

Various additives may be added to the insulator as necessary. Examples of the additives include an antioxidant, a metal deactivator, and a processing aid (e.g., lubricant, wax).

The above-described insulated wire can be produced by extrusion-covering the conductor with ingredients of the insulator preferably with the use of a regular extrusion molding machine, the ingredients being kneaded preferably with the use of a regular kneader such as a Banbury mixer, a pressure kneader and a roll.

EXAMPLE

A description of the present invention will now be provided specifically with reference to Examples; however, the present invention is not limited thereto.

(Preparation of a Copper Wire for Electric Purpose)

A copper wire for electric purpose was prepared by melting electrolytic copper and subjecting it to continuous casting and rolling with the use of a casting and rolling machine to produce a wire rod of 8 mm in diameter, and then subjecting the wire rod to cold wire drawing processing so as to have a desired diameter.

(Preparation of Wires of Cu—Ni—Si Alloys)

Each copper alloy wire having a desired diameter was prepared as follows. A molten metal of a copper alloy which was produced such that each ingredient had a desired percentage shown in Table 1 was rapidly solidified with the use of an intermittent continuous-casting machine in which a water-cooled die was used, and a wire rod of 24 mm in diameter was obtained. Then, the wire rod was subjected to cold rolling, and a wire rod of 8 mm in diameter was obtained. Then, the wire rod was subjected to cold wire drawing processing to obtain a copper alloy wire having a desired diameter.

(Preparation of Wires of Copper Alloys Containing Sn, Ag, Mg, or Zn)

Each copper alloy wire having a desired diameter was prepared as follows. Electrolytic copper was melted, and while an additive element was continuously added to the electrolytic copper such that the element had a desired percentage shown in Table 1, the electrolytic copper was subjected to continuous casting and rolling with the use of a casting and rolling machine to obtain a wire rod of 8 mm in diameter. Then, the wire rod was subjected to cold wire drawing processing to obtain a copper alloy wire having a desired diameter.

Example 1

A conductor according to Example 1 was prepared by stranding three copper wires for electric purpose and four Cu—Ni—Si alloy wires, and subjecting the stranded wires to heat treatment for thermal refining at 440° C. for 8 hours. The prepared conductor was measured for tensile strength, breaking elongation, and electrical conductivity by measuring methods to be described below. In addition, corrosion resistance of the conductor was evaluated based on a standard electrode potential difference between the materials from which the conductor was made, and also recyclability of the conductor was evaluated based on the materials from which the conductor was made. Results thereof are shown in Table 1.

Example 2

A conductor according to Example 2 was prepared by stranding two copper wires for electric purpose and five Cu—Ni—Si alloy wires, and subjecting the stranded wires to heat treatment for thermal refining at 400° C. for 8 hours. Measurement and evaluation of the conductor were made in the same manner as Example 1. Results thereof are shown in Table 1.

Example 3

A conductor according to Example 3 was prepared by stranding thirteen copper wires for electric purpose and six Cu—Ni—Si alloy wires, and subjecting the stranded wires to heat treatment for thermal refining at 380° C. for 8 hours. Measurement and evaluation of the conductor were made in the same manner as Example 1. Results thereof are shown in Table 1.

Examples 4 to 7

Conductors according to Examples 4 to 7 were each prepared by stranding three copper wires for electric purpose and four copper alloy wires containing one additive element shown in Table 1, and subjecting the stranded wires to heat treatment for thermal refining at 380° C. for 8 hours. Measurement and evaluation of the conductors were made in the same manner as Example 1. Results thereof are shown in Table 1.

Comparative Example 1

A conductor according to Comparative Example 1 was prepared by stranding seven copper wires for electric purpose, and subjecting the stranded wires to continuous softening. Measurement and evaluation of the conductor were made in the same manner as Example 1. Results thereof are shown in Table 1.

Comparative Example 2

A conductor according to Comparative Example 2 was prepared by stranding eight copper wires for electric purpose and one stainless steel wire, and subjecting the stranded wires to continuous softening. Measurement and evaluation of the conductor were made in the same manner as Example 1. Results thereof are shown in Table 1.

Comparative Example 3

A conductor according to Comparative Example 3 was prepared by stranding seven copper alloy wires containing the additive elements shown in Table 1, and subjecting the stranded wires to heat treatment for thermal refining at 480° C. for 8 hours. Measurement and evaluation of the conductor were made in the same manner as Example 1. Results thereof are shown in Table 1.

Comparative Example 4

A conductor according to Comparative Example 4 was prepared by stranding seven copper alloy wires containing the additive element shown in Table 1. No heat treatment was performed on the conductor. Measurement and evaluation of the conductor were made in the same manner as Example 1. Results thereof are shown in Table 1.

Tensile Strength

Tensile strength was measured by a common tensile strength tester. Tensile strength of 300 MPa or more was regarded as passed.

Breaking Elongation

Breaking elongation was measured by a common tensile strength tester. Breaking elongation of 5% or more was regarded as passed.

Electrical Conductivity

Electrical conductivity was measured by a bridge method. Electrical conductivity of 45% IACS (International Annealed Copper Standard) or more was regarded as passed.

TABLE 1

| | | Composition of conductor | | | | | | |
|---|---|---|---|---|---|---|---|---|
| | | Material 1 | | Material 2 | | | Percentage of cross-sectional area of copperwire for electric purpose % | Heat treatment for thermal refining |
| | | Type | Number of wires | Type | Additive element | Number of wires | | |
| Example | 1 | Copper wire for electric purpose | 3 | Copper alloy wire | 2.6% Ni 0.5% Si | 4 | 43 | 440° C. × 8 Hr |
| | 2 | Copper wire for electric purpose | 2 | Copper alloy wire | 2.6% Ni 0.5% Si | 5 | 29 | 400° C. × 8 Hr |
| | 3 | Copper wire for electric purpose | 13 | Copper alloy wire | 2.6% Ni 0.5% Si | 6 | 68 | 380° C. × 8 Hr |
| | 4 | Copper wire for electric purpose | 3 | Copper alloy wire | 0.3% Sn | 4 | 43 | 380° C. × 4 Hr |
| | 5 | Copper wire for electric purpose | 3 | Copper alloy wire | 0.6% Ag | 4 | 43 | 380° C. × 4 Hr |
| | 6 | Copper wire for electric purpose | 3 | Copper alloy wire | 0.3% Mg | 4 | 43 | 380° C. × 4 Hr |

TABLE 1-continued

| | | | | | | | | |
|---|---|---|---|---|---|---|---|---|
| | 7 | Copper wire for electric purpose | 3 | Copper alloy wire | 0.9% Zn | 4 | 43 | 380° C. × 4 Hr |
| Comparative Example | 1 | Copper wire for electric purpose | 7 | — | — | — | 100 | Continuous softening |
| | 2 | Copper wire for electric purpose | 8 | Stainless steel wire | 18% Cr 8% Ni | 1 | 75 | Continuous softening |
| | 3 | — | — | Copper alloy wire | 2.6% Ni 0.5% Si | 7 | 0 | 480° C. × 8 Hr |
| | 4 | — | — | Copper alloy wire | 0.3% Sn | 7 | 0 | — |

| | | Evaluation | | | | |
|---|---|---|---|---|---|---|
| | | Physical property | | | Corrosion resistance | |
| | | Tensile strength MPa | Breaking elongation % | Electrical conductivity % | Corrosion potential difference V | Recyclability |
| Example | 1 | 385 | 10 | 66 | 0.02 | Excellent |
| | 2 | 320 | 5 | 56 | 0.02 | Excellent |
| | 3 | 305 | 5 | 87 | 0.02 | Excellent |
| | 4 | 340 | 7 | 77 | 0.02 | Excellent |
| | 5 | 330 | 7 | 89 | 0.02 | Excellent |
| | 6 | 345 | 6 | 77 | 0.02 | Excellent |
| | 7 | 360 | 5 | 86 | 0.02 | Excellent |
| Comparative Example | 1 | 240 | 35 | 102 | 0 | Excellent |
| | 2 | 500 | 20 | 75 | 0.25 | Poor |
| | 3 | 360 | 15 | 38 | 0 | Excellent |
| | 4 | 700 | 2 | 60 | 0 | Excellent |

According to Table 1, it is shown that the conductors according to the Comparative Examples all have failures in some of the evaluation items of tensile strength, breaking elongation, electrical conductivity, corrosion resistance, and recyclability.

To be specific, the conductor according to Comparative Example 1 is made up only of the copper wires for electric purpose, so that it is poor in tensile strength while excellent in breaking elongation, electrical conductivity, corrosion resistance, and recyclability. The conductor according to Comparative Example 2 is made up of the copper wires for electric purpose and the stainless steel wire, so that it is poor in recyclability because it is made from metals of different kinds, while excellent in tensile strength. In addition, the conductor according to Comparative Example 2 is poor in corrosion resistance because a standard electrode potential difference of the conductor is large.

The conductor according to Comparative Example 3 is made up only of the copper alloy wires, so that it is poor in electrical conductivity because of high electric resistance, while excellent in tensile strength. The conductor according to Comparative Example 4 is also made up only of the copper alloy wires, so that it is poor in breaking elongation because no heat treatment is performed thereon, while excellent in tensile strength.

Meanwhile, it is shown that the conductors according to the present Examples are excellent all in tensile strength, breaking elongation, electrical conductivity, corrosion resistance, and recyclability.

That is, it is shown that stranding the copper wires for electric purpose and the copper alloy wires appropriately in combination allows a conductor to be obtained which is excellent in tensile strength while maintaining appropriate breaking elongation and electric conductivity, which cannot be obtained by stranding only wire conductors for electric purpose which is of conventional style. In addition, it is shown that the conductors according to the present Examples are excellent in corrosion resistance because their standard electrode potential differences between copper and copper alloys are small, and that the conductors are excellent also in recyclability because they are each made from a copper-based material and can be recycled as a copper-based material without separation.

Therefore, also in achieving weight reduction and diameter reduction of an insulated wire by using the conductor according to the preferred embodiments of the present invention in a small-diameter insulated wire such as a wire having a nominal cross-sectional area of 0.5 $mm^2$ or less, for example, the strength of the insulated wire which is decreased by weight reduction and diameter reduction can be improved.

The foregoing description of the preferred embodiments of the present invention has been presented for purposes of illustration and description; however, it is not intended to be exhaustive or to limit the present invention to the precise form disclosed, and modifications and variations are possible as long as they do not deviate from the principles of the present invention.

What is claimed is:

1. A conductor comprising a strand consisting of:

a first elemental wire made from pure copper; and a second elemental wire made from a copper alloy, the first elemental wire and the second elemental wire being stranded, wherein the first elemental wire is 10% to 43% of the cross-sectional area of the conductor, and wherein the copper alloy contains:

Zn, where a total content of the Zn is 0.15 to 1.0 mass %; and a remainder essentially includes Cu and an unavoidable impurity.

2. The conductor according to claim 1, wherein the conductor has a cross-sectional area of 0.5 $mm^2$ or less.

3. The conductor according to claim 1, wherein the conductor is compressed concentrically.

4. An insulated wire comprising the conductor according to claim 1.

5. A conductor comprising a strand consisting of:

a first elemental wire made from pure copper; and a second elemental wire made from a copper alloy, the first elemental wire and the second elemental wire being stranded, wherein the first elemental wire is 10% to 43% of the cross-sectional area of the conductor, and wherein the copper alloy contains:

Mg, where a total content of the Mg is 0.15 to 1.0 mass %; and a remainder essentially includes Cu and an unavoidable impurity.

6. The conductor according to claim 5, wherein the conductor has a cross-sectional area of 0.5 $mm^2$ or less.

7. The conductor according to claim 5, wherein the conductor is compressed concentrically.

8. An insulated wire comprising the conductor according to claim 5.

9. A conductor comprising a strand consisting of:

a first elemental wire made from pure copper; and a second elemental wire made from a copper alloy, the first elemental wire and the second elemental wire being stranded, wherein the first elemental wire is 10% to 43% of the cross-sectional area of conductor and wherein the copper alloy contains:

Ag, where a total content of the Ag is 0.15 to 1.0mass %; and a remainder essentially includes Cu and an unavoidable impurity.

10. The conductor according to claim 9, wherein the conductor has a cross-sectional area of 0.5 $mm^2$ or less.

11. The conductor according to claim 9, wherein the conductor is compressed concentrically.

12. An insulated wire comprising the conductor according to claim 9.

* * * * *